US011149974B2

(12) United States Patent
Kitade et al.

(10) Patent No.: US 11,149,974 B2
(45) Date of Patent: Oct. 19, 2021

(54) AIR CONDITIONER SELECTION SYSTEM

(71) Applicant: Daikin Industries, LTD., Osaka (JP)

(72) Inventors: Yukio Kitade, Osaka (JP); Nobuyoshi Kawakami, Osaka (JP); Kousuke Shiohama, Osaka (JP); Masashi Saitou, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 37 days.

(21) Appl. No.: 16/490,937

(22) PCT Filed: Mar. 20, 2018

(86) PCT No.: PCT/JP2018/011213

§ 371 (c)(1),
(2) Date: Sep. 4, 2019

(87) PCT Pub. No.: WO2018/186175

PCT Pub. Date: Oct. 11, 2018

(65) Prior Publication Data

US 2020/0018502 A1 Jan. 16, 2020

(30) Foreign Application Priority Data

Apr. 4, 2017 (JP) ..... JP2017-074480

(51) Int. Cl.
*F24F 11/30* (2018.01)
*F24F 1/0043* (2019.01)
(Continued)

(52) U.S. Cl.
CPC ..... *F24F 11/30* (2018.01); *F24F 1/0043* (2019.02); *F24F 11/64* (2018.01); *F25B 49/005* (2013.01);
(Continued)

(58) Field of Classification Search
CPC ..... F24F 11/30; F25B 49/005; F25B 2400/12; F25B 2500/01
See application file for complete search history.

(56) References Cited

U.S. PATENT DOCUMENTS

2016/0327303 A1* 11/2016 Tomita ..... F25B 49/005
2017/0284718 A1 10/2017 Suzuki et al.

FOREIGN PATENT DOCUMENTS

CN 104573292 A 4/2015
JP 8-94150 A 4/1996
(Continued)

OTHER PUBLICATIONS

International Preliminary Report of corresponding PCT Application No. PCT/JP2018/011213 dated Oct. 17, 2019.
(Continued)

*Primary Examiner* — Jonathan Bradford
(74) *Attorney, Agent, or Firm* — Global IP Counselors, LLP

(57) ABSTRACT

An air conditioner selection system is a system for selecting an air conditioner including an indoor unit. The air conditioner selection system is provided with a floor area acquisition section, an allowable refrigerant amount acquisition section, and an air conditioner selection section. The floor area acquisition section acquires a floor area of a room where the indoor unit is to be installed. The allowable refrigerant amount acquisition section acquires an allowable refrigerant amount of a refrigerant allowed to remain in the room at least based on the floor area acquired by the floor area acquisition section. The air conditioner selection section selects the air conditioner including the indoor unit installable in the room at least based on the allowable refrigerant amount acquired by the allowable refrigerant amount acquisition section.

8 Claims, 4 Drawing Sheets

(51) Int. Cl.
*F25B 49/00* (2006.01)
*F24F 11/64* (2018.01)

(52) U.S. Cl.
CPC ..... *F25B 2400/12* (2013.01); *F25B 2500/01* (2013.01)

(56) References Cited

FOREIGN PATENT DOCUMENTS

| | | | |
|---|---|---|---|
| JP | 2006-266642 | A | 10/2006 |
| JP | 2011-123617 | A | 6/2011 |
| JP | 2016-151376 | A | 8/2016 |
| JP | 2016-188758 | A | 11/2016 |
| JP | 2017-27433 | A | 2/2017 |

OTHER PUBLICATIONS

International Search Report of corresponding PCT Application No. PCT/JP2018/011213 dated Jun. 5, 2018.
European Search Report of corresponding EP Application No. 18 78 1424.9 dated Oct. 20, 2020.

* cited by examiner

AIR CONDITIONER SELECTION SYSTEM

TECHNICAL FIELD

The present invention relates to an air conditioner selection system for selecting an air conditioner that satisfies a predetermined safety standard requirement.

BACKGROUND ART

There have been conventionally known various methods for selecting an air conditioner to be installed in a building. As disclosed in Patent Literature 1 (JP 8-94150 A), various standards, such as a heat load of a building where an air conditioner is to be installed, are used in selecting an air conditioner. In view of safety, an air conditioner is selected so that a safety standard requirement in a case where a refrigerant leaks out of an air conditioning unit of the air conditioner is satisfied. In this case, for example, an appropriate air conditioner is preferably selected according to specifications of a room where an indoor unit as an air conditioning unit is to be installed and the type of a refrigerant used in the air conditioner.

SUMMARY OF THE INVENTION

Technical Problem

However, in selection of an air conditioner to be installed inside a building including a large number of rooms, such as an office building, when an air conditioner that satisfies a predetermined safety standard requirement is not appropriately selected, it is detected on a construction site that it is impossible to construct the building, and it is necessary to reselect an air conditioner. As a result, operations such as review of a construction plan and repreparation of the construction are required, which may generate cost that is not required if an air conditioner can be appropriately selected in the design stage before the construction. Thus, it is preferred that an air conditioner that satisfies a predetermined safety standard requirement can be appropriately and efficiently determined in the stage before the construction of a building.

It is an object of the present invention to provide an air conditioner selection system capable of efficiently selecting an air conditioner that satisfies a safety standard requirement in a case where a refrigerant leaks.

Solution to Problem

An air conditioner selection system according to a first aspect of the present invention is a system for selecting an air conditioner including an air conditioning unit. The air conditioner selection system includes a floor area acquisition section, an allowable refrigerant amount acquisition section, and an air conditioner selection section. The floor area acquisition section acquires a floor area of a target space where the air conditioning unit is to be installed. The allowable refrigerant amount acquisition section acquires an allowable refrigerant amount of a refrigerant allowed to remain in the target space at least based on the floor area acquired by the floor area acquisition section. The air conditioner selection section selects the air conditioner including the air conditioning unit installable in the target space at least based on the allowable refrigerant amount acquired by the allowable refrigerant amount acquisition section.

The air conditioner selection system according to the first aspect acquires the floor area of the target space where the air conditioning unit is to be installed and acquires the allowable refrigerant amount at least based on the floor area. The target space is, for example, a room where an indoor unit as the air conditioning unit is to be installed. The floor area is calculated from a drawing and a photograph of the room as the target space. The allowable refrigerant amount is the amount of a refrigerant allowed to remain in the target space in a case where the refrigerant leaks out of the air conditioning unit or the like into the target space. The air conditioner selection system is capable of efficiently selecting the air conditioner that satisfies a safety standard requirement in a case where the refrigerant leaks by selecting the air conditioner based on the allowable refrigerant amount.

An air conditioner selection system according to a second aspect of the present invention is the air conditioner selection system according to the first aspect further including an air conditioner determination section. The air conditioner determination section is a section for determining the air conditioning unit to be installed in the target space based on the air conditioner selected by the air conditioner selection section.

The air conditioner selection system according to the second aspect has a function capable of determining the required air conditioning unit based on a candidate for the air conditioner selected based on the safety standard requirement in a case where the refrigerant leaks. In the air conditioner selection system, a manager or the like of the air conditioner can efficiently determine the air conditioning unit of the air conditioner that satisfies the safety standard requirement in a case where the refrigerant leaks.

An air conditioner selection system according to a third aspect of the present invention is the air conditioner selection system according to the first aspect or the second aspect in which the allowable refrigerant amount acquisition section acquires the allowable refrigerant amount further based on a target space height that is a dimension of the target space in a vertical direction.

The air conditioner selection system according to the third aspect is capable of selecting the air conditioner based on the floor area of the target space and the target space height that is the dimension of the target space in the vertical direction. In this case, for example, the air conditioner selection system calculates a leakage height that is a height position at which the refrigerant may leak out of the air conditioning unit or the like in the target space based on the target space height and acquires the allowable refrigerant amount based on the floor area of the target space and the leakage height. The leakage height varies according to the type of the air conditioning unit to be installed in the target space. Thus, the air conditioner selection system is capable of efficiently selecting the air conditioner that satisfies the safety standard requirement in a case where the refrigerant leaks according to the type of the air conditioning unit.

An air conditioner selection system according to a fourth aspect of the present invention is the air conditioner selection system according to the third aspect in which the allowable refrigerant amount acquisition section acquires the allowable refrigerant amount further based on a lower flammable limit of a refrigerant.

The air conditioner selection system according to the fourth aspect is capable of selecting the air conditioner based on the floor area of the target space, the target space height, and the flammability of the refrigerant used in the air conditioner. The air conditioner selection system is capable of efficiently selecting the air conditioner that satisfies the safety standard requirement in a case where the refrigerant leaks according to the property of the refrigerant used in the air conditioner.

An air conditioner selection system according to a fifth aspect of the present invention is the air conditioner selection system according to any one of the first to fourth aspects further including an air conditioning capacity acquisition section. The air conditioning capacity acquisition section acquires an air conditioning capacity required of the target space. The air conditioner selection section selects an air conditioner further based on the air conditioning capacity acquired by the air conditioning capacity acquisition section.

The air conditioner selection system according to the fifth aspect is capable of selecting the air conditioner further based on the air conditioning capacity required of the target space. The air conditioning capacity is, for example, acquired based on specifications of the target space, a building including the target space, and the air conditioning unit. The air conditioner selection system is capable of efficiently selecting the air conditioner having the air conditioning capacity required of the space where the air conditioning unit is to be installed.

An air conditioner selection system according to a sixth aspect of the present invention is the air conditioner selection system according to any one of the first to fifth aspects further including an air conditioner output section. The air conditioner output section outputs the air conditioner selected by the air conditioner selection section.

The air conditioner selection system according to the sixth aspect has a function of outputting, by display on a display and printing, information relating to the air conditioner selected based on the safety standard requirement in a case where the refrigerant leaks. The air conditioner selection system is capable of notifying the manager or the like of the air conditioner of information relating to the air conditioner that satisfies the safety standard requirement in a case where the refrigerant leaks.

An air conditioner selection system according to a seventh aspect of the present invention is the air conditioner selection system according to any one of the first to sixth aspects in which the air conditioner uses a refrigerant including a flammable refrigerant.

The air conditioner selection system according to the seventh aspect is capable of efficiently selecting the air conditioner that satisfies the safety standard requirement in a case where the flammable refrigerant such as R32 leaks.

Advantageous Effects of Invention

The air conditioner selection system according to the first aspect of the present invention is capable of efficiently selecting the air conditioner that satisfies the safety standard requirement in a case where the refrigerant leaks.

In the air conditioner selection system according to the second aspect of the present invention, a manager or the like of the air conditioner can efficiently determine the air conditioning unit of the air conditioner that satisfies the safety standard requirement in a case where the refrigerant leaks.

The air conditioner selection system according to the third aspect of the present invention is capable of efficiently selecting the air conditioner that satisfies the safety standard requirement in a case where the refrigerant leaks according to the type of the air conditioning unit.

The air conditioner selection system according to the fourth aspect of the present invention is capable of efficiently selecting the air conditioner that satisfies the safety standard requirement in a case where the refrigerant leaks according to the property of the refrigerant used in the air conditioner.

The air conditioner selection system according to the fifth aspect of the present invention is capable of efficiently selecting the air conditioner having the air conditioning capacity required of the space where the air conditioning unit is to be installed.

The air conditioner selection system according to the sixth aspect of the present invention is capable of notifying a manager or the like of the air conditioner of information relating the air conditioner that satisfies the safety standard requirement in a case where the refrigerant leaks.

The air conditioner selection system according to the seventh aspect of the present invention is capable of efficiently selecting the air conditioner that satisfies the safety standard requirement in a case where the flammable refrigerant such as R32 leaks.

DESCRIPTION OF EMBODIMENTS

Figure 1:
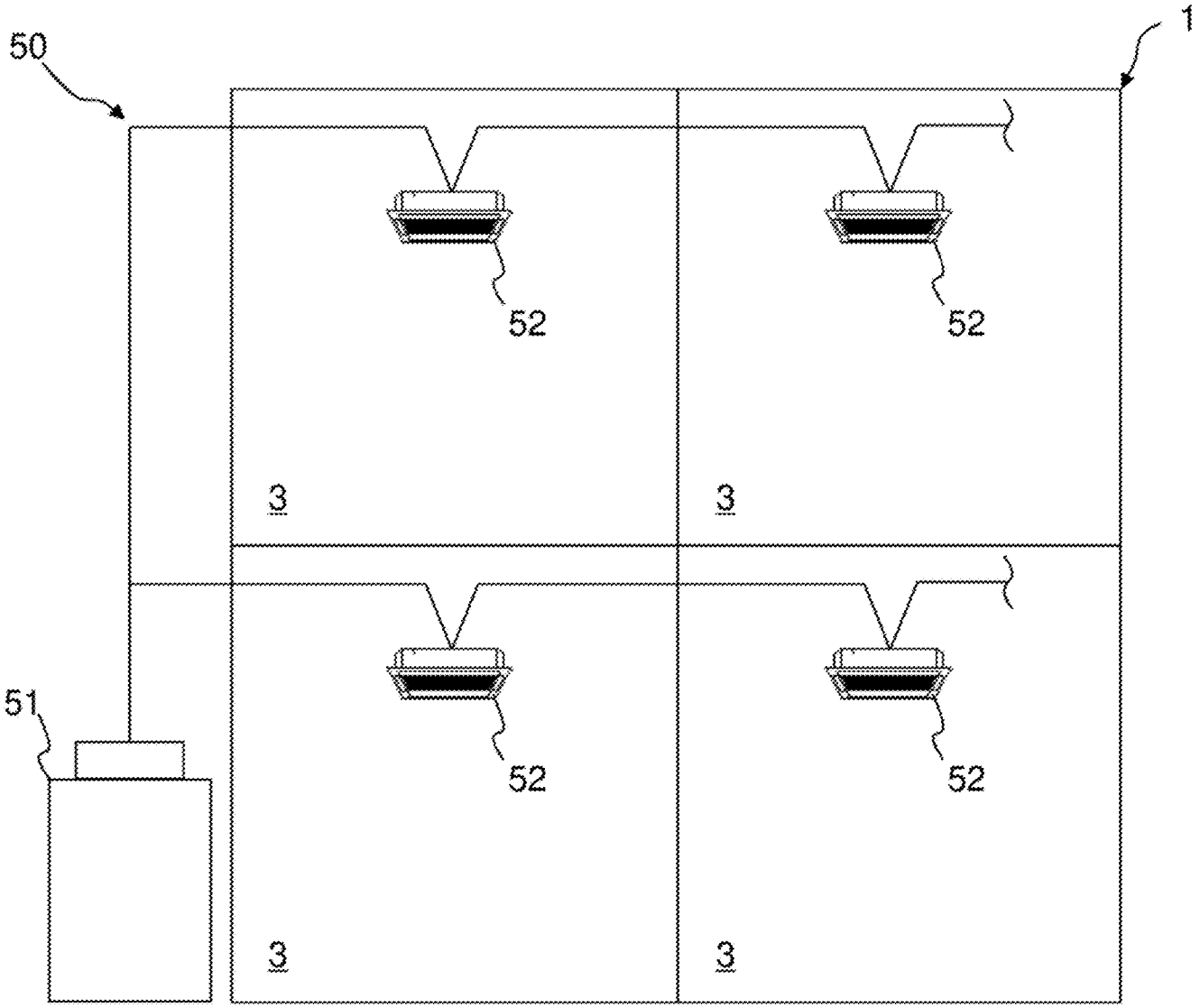
FIG. 1 is a diagram illustrating the entire configuration of an air conditioner 50.

An air conditioner selection system 100 according to an embodiment of the present invention will be described with reference to the drawings.

(1) Entire Configuration

The air conditioner selection system 100 is a system for selecting one or more air conditioners 50 that satisfy a predetermined condition from a plurality of air conditioners 50. The air conditioner 50 is a refrigeration apparatus provided with an outdoor unit 51 and an indoor unit 52. The air conditioner selection system 100, for example, selects a combination of the outdoor unit 51 and the indoor unit 52 to select the air conditioner 50 that satisfies the predetermined condition. In this case, the air conditioner selection system 100 selects a combination of an outdoor unit 51 and an indoor unit 52, which satisfies the predetermined condition, from a plurality of outdoor units 51 and a plurality of indoor units 52. The predetermined condition is, for example, a safety standard requirement based on a law or the like.

FIG. 1 is a diagram illustrating the entire configuration of the air conditioner 50. The air conditioner 50 is installed in a property 1 which includes a plurality of rooms 3. The property 1 is a building such as an office building. One air conditioner 50 is installed in the property 1. The air conditioner 50 is a single-system packaged air conditioner which includes one outdoor unit 51 and a plurality of indoor units 52. The outdoor unit 51 is an air conditioning unit provided with a compressor, a heat exchanger, an expansion mechanism, a fan, and the like. The outdoor unit 51 is installed outside the property 1. The indoor unit 52 is an air conditioning unit provided with a heat exchanger, a fan, and the like. The indoor unit 52 is installed in the room 3 inside the property 1. The room 3 is a target space where the indoor unit 52 is to be installed. One indoor unit 52 is installed in one room 3. The outdoor unit 51 and the indoor unit 52 are connected through a refrigerant pipe to constitute a refrigerant circuit.

The air conditioner selection system 100 is used in selecting the air conditioner 50 to be installed in the property 1. A person in charge of constructing the property 1 can determine the air conditioner 50 to be installed in the property 1 from the one or more air conditioners 50 selected by the air conditioner selection system 100 in the stage before the construction of the property 1. Accordingly, the person in charge of constructing the property 1 can appropriately and efficiently determine, using the air conditioner selection system 100, the air conditioner 50 that satisfies the predetermined safety standard requirement in the stage before the construction of the property 1.

In the following description, the air conditioner selection system 100 is a system for selecting the air conditioner 50 so that a safety standard requirement in a case where a refrigerant leaks out of the indoor unit 52 or the like into the room 3 is satisfied.

Figure 2:
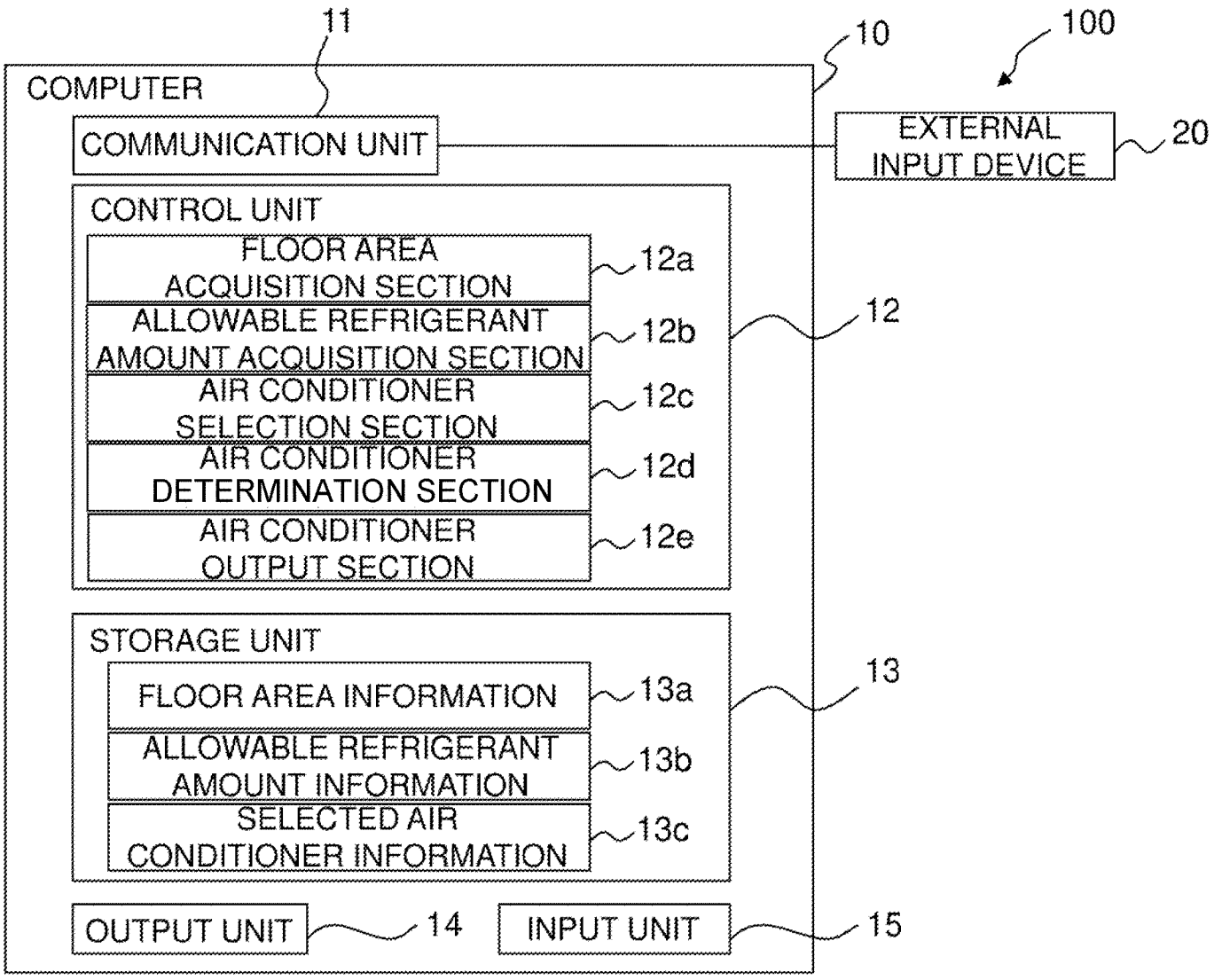
FIG. 2 is a block diagram illustrating the entire configuration of an air conditioner selection system 100 of an embodiment.

FIG. 2 is a block diagram illustrating the entire configuration of the air conditioner selection system 100. The air conditioner selection system 100 is mainly provided with a computer 10 and an external input device 20. The person in charge of constructing the property 1 can determine the air conditioner 50 that satisfies the predetermined safety standard requirement using the computer 10 and the external input device 20.

The computer 10 is mainly provided with a communication unit 11, a control unit 12, a storage unit 13, an output unit 14, and an input unit 15. The computer 10 is, for example, a laptop computer.

The communication unit 11 is an interface for a communication network and an external device. The communication unit 11 is, for example, a network interface for connecting the computer 10 to a communication network such as the Internet and a general-purpose internal for connecting the computer 10 to an external device such as a printer.

The control unit 12 mainly includes a CPU. The control unit 12 executes a floor area acquisition section 12*a*, an allowable refrigerant amount acquisition section 12*b*, an air conditioner selection section 12*c*, an air conditioner determination section 12*d*, and an air conditioner output section 12*e*. These sections are programs executed by the control unit 12. The operations of these programs will be described later.

The storage unit 13 mainly includes storage devices such as a RAM, a HDD, and an SSD. The storage unit 13 stores the programs executed by the control unit 12 and data used by the programs. The storage unit 13 stores floor area information 13*a*, allowable refrigerant amount information 13*b*, and selected air conditioner information 13*c*. These pieces of information will be described later.

The output unit 14 is an output device of the computer 10, such as a display and a printer. For example, an interface for starting processing of a program executed by the control unit 12 and a processing result of the program executed by the control unit 12 are displayed on the display as the output unit 14.

The input unit 15 is an input device of the computer 10, such as a keyboard and a mouse. A user of the air conditioner selection system 100 who is the person in charge of constructing the property 1 operates the input unit 15 to operate the air conditioner selection system 100.

For example, the output unit 14 and the input unit 15 may be integrally constructed as a display with a touch panel function and a speaker function.

The external input device 20 is, for example, a camera and a scanner. The external input device 20 is connected to the communication unit 11 of the computer 10. The external input device 20 is capable of transmitting data to the computer 10 via the communication unit 11.

(2) Functions of Control Unit

Next, each program executed by the control unit 12 of the computer 10 will be described.

(2-1) Floor Area Acquisition Section

The floor area acquisition section 12*a* acquires the floor area of the room 3 as the target space where the indoor unit 52 is to be installed. When the spatial shape of the room 3 is regarded as a cylinder body, the floor area is the area of the bottom face of the cylinder body. The cylinder body includes a quadrangular prism and a column.

The floor area acquisition section 12*a* captures room spatial information, which is data relating to an internal space of the room 3, from the outside and acquires the floor area of the room 3 based on the room spatial information. The storage unit 13 stores the floor area acquired by the floor area acquisition section 12*a* as the floor area information 13*a*. Next, some methods for capturing room spatial information and acquiring the floor area of the room 3 by the floor area acquisition section 12*a* will be described.

First, the floor area acquisition section 12*a* may capture drawing data of the room 3 as room spatial information. The drawing data is data such as a CAD file and a PDF file. For example, the floor area acquisition section 12*a* captures room spatial information stored in an external storage device such as a USB memory via the communication unit 11 which is a general-purpose interface. Further, for example, the floor area acquisition section 12*a* captures room spatial information stored in a server on a network via the communication unit 11 which is the network interface. The floor area acquisition section 12*a* calculates the floor area of the room 3 from the captured room spatial information using a dedicated application. The dedicated application is, for example, CAD software.

Second, the floor area acquisition section 12*a* may capture image data obtained by scanning a printed drawing of the room 3 using an image scanner as the external input device 20 as room spatial information. In this case, the floor area acquisition section 12*a* captures the room spatial information which is the image data read by the image scanner via the communication unit 11 which is the general-purpose interface. The floor area acquisition section 12*a* analyzes the image data as the captured room spatial information to calculate the floor area of the room 3 using a dedicated application. Alternatively, the floor area acquisition section 12*a* may generate drawing data of the room 3 based on the image data as the captured room spatial information and calculate the floor area of the room 3 from the generated drawing data using a dedicated application.

Third, the floor area acquisition section 12*a* may capture image data acquired by photographing a state inside the room 3 using the camera as the external input device 20 as room spatial information. The image data is a still image or a moving image. In this case, the floor area acquisition section 12*a* captures the room spatial information, which is the image data captured by the camera, via the communication unit 11 which is the general-purpose interface. The floor area acquisition section 12*a* analyzes the image data as the captured room spatial information to calculate the floor area of the room 3 using a dedicated application. Alternatively, the floor area acquisition section 12*a* may generate drawing data of the room 3 based on the image data as the captured room spatial information and calculate the floor area of the room 3 from the generated drawing data using a dedicated application.

Alternatively, the floor area acquisition section 12*a* may analyze moving image data of a state inside the room 3 to generate 3D data relating to the spatial shape of the room 3 using a motion capture function. In this case, the floor area acquisition section 12*a* calculates the floor area of the room 3 based on the generated 3D data.

Fourth, the floor area acquisition section 12*a* may capture drawing created by a user of the air conditioner selection system 100 inside the room 3 as room spatial information. In this case, the user of the air conditioner selection system 100 measures various dimensions of the room 3 using a measuring tape or the like to create a simple plan of the room 3. The user of the air conditioner selection system 100 may create the plan of the room 3 on the computer 10 using CAD software or the like or may capture the plan of the room 3 drawn on a piece of paper into the computer 10 by the external input device 20 (the camera or the image scanner). In this case, the user of the air conditioner selection system 100 may designate a part corresponding to a wall surface of the room 3 on the plan of the room 3 displayed on the display as the output unit 14, and the floor area acquisition section 12*a* may thereby calculate the floor area of the room 3. In this manner, the floor area acquisition section 12*a* may acquire the floor area of the room 3 based on the drawing created by the user of the air conditioner selection system 100 in the room 3.

(2-2) Allowable Refrigerant Amount Acquisition Section

The allowable refrigerant amount acquisition section 12*b* acquires an allowable refrigerant amount of the room 3 at least based on the floor area of the room 3. The allowable refrigerant amount is the amount of a refrigerant that is allowed to remain in the room 3 as the target space where the indoor unit 52 is to be installed when the refrigerant leaks out of the air conditioner 50 provided with the indoor unit 52 in the room 3. That is, the air conditioner 50 having a possibility that the refrigerant exceeding the allowable refrigerant amount remains in the room 3 in refrigerant leakage is considered not to satisfy the predetermined safety standard requirement.

In the present embodiment, the allowable refrigerant amount acquisition section 12*b* calculates the allowable refrigerant amount of the room 3 based on the floor area of the room 3, a leakage height of the room 3, and a refrigerant parameter.

The floor area of the room 3 is a value acquired by the floor area acquisition section 12*a*. The floor area of the room 3 is stored as the floor area information 13*a* in the storage unit 13.

The leakage height of the room 3 is a height position of a refrigerant leakage location when the refrigerant leaks out of the indoor unit 52 into the room 3. The leakage height of the room 3 is a position based on the height position of the floor of the room 3. The leakage height of the room 3 varies according to the type of the indoor unit 52 to be installed in the room 3. For example, when the indoor unit 52 is embedded in the ceiling of the room 3, the leakage height of the room 3 is the height position of the ceiling of the room 3. On the other hand, when the indoor unit 52 is attached to the wall of the room 3, the leakage height of the room 3 is the height position of an air vent of the indoor unit 52. A predetermined value is previously set as the leakage height of the room 3 according to the dimension of the room 3 and the type of the indoor unit 52 to be installed in the room 3. Alternatively, the allowable refrigerant amount acquisition section 12*b* may acquire the leakage height of the room 3 based on the room spatial information captured by the floor area acquisition section 12*a* and the type of the indoor unit 52. For example, when the indoor unit 52 is embedded in the ceiling of the room 3, the allowable refrigerant amount acquisition section 12*b* may acquire the dimension of the room 3 in the vertical direction as the leakage height of the room 3.

The refrigerant parameter is set according to the property of the refrigerant used in the air conditioner 50. For example, the refrigerant parameter is calculated based on the concentration of the refrigerant, the flammability of the refrigerant, and the lower flammable limit (LFL) of the refrigerant.

In the present embodiment, the allowable refrigerant amount acquisition section 12*b* calculates an allowable refrigerant amount V by the following formula (I).

$$V=k\times L\times h\times S \quad \text{(I)}$$

In formula (I), the variable k is a dimensionless value based on the flammability of the refrigerant used in the air conditioner 50. In the present embodiment, when the refrigerant is flammable, k is set to 0.25. When the refrigerant is nonflammable, k is set to 0.50. The flammable refrigerant is, for example, R32. The nonflammable refrigerant is, for example, carbon dioxide.

In formula (I), the variable L is the lower flammable limit of the refrigerant used in the air conditioner 50. The lower flammable limit of the refrigerant is a lower limit of the concentration of the refrigerant within the flammable range. In the flammable range, a mixture of the refrigerant and air is flammable or ignitable. The variable L is a dimensionless value. The refrigerant parameter corresponds to the product of the variable k and the variable L.

In formula (I), the variable h is the leakage height (m) of the room 3, and the variable S is the floor area ($m^2$) of the room 3. The allowable refrigerant amount V ($m^3$) is calculated by multiplying all the four variables k, L, h, S. The storage unit 13 stores the allowable refrigerant amount V of the room 3 calculated by the allowable refrigerant amount acquisition section 12*b* as the allowable refrigerant amount information 13*b*.

(2-3) Air Conditioner Selection Section

The air conditioner selection section 12*c* selects the air conditioner 50 including the indoor unit 52 installable in the room 3 at least based on the allowable refrigerant amount of the room 3. The allowable refrigerant amount of the room 3 is a value acquired by the allowable refrigerant amount acquisition section 12*b*. The air conditioner selection section 12*c* selects one or more air conditioners 50.

The air conditioner selection section 12*c*, for example, selects the air conditioner 50 based on the allowable refrigerant amount of the room 3 and a total refrigerant amount of the air conditioner 50. The total refrigerant amount of the air conditioner 50 is the capacity of the refrigerant used in the single-system packaged air conditioner 50. The total refrigerant amount of the air conditioner 50 is determined based on specifications of the outdoor unit 51 and the indoor unit 52, the number of indoor units 52, and the length of the refrigerant pipe or the like. The specifications of the outdoor unit 51 and the indoor unit 52 include the capacity of the compressor of the outdoor unit 51 and the capacity of a refrigerant passage of the heat exchanger of each of the outdoor unit 51 and the indoor unit 52. The total refrigerant amount of the air conditioner 50 depends on the combination of the outdoor unit 51 and the indoor unit 52 which constitute the air conditioner 50.

The air conditioner selection section 12*c* calculates the total refrigerant amount of the air conditioner 50 based on the specifications of the outdoor unit 51 and the indoor unit 52, the number of indoor units 52, and the length of the refrigerant pipe. In this case, the number of indoor units 52 and the length of the refrigerant pipe may be input by the user of the air conditioner selection system 100 via the input unit 15. Alternatively, the number of indoor units 52 and the length of the refrigerant pipe may be automatically set by the control unit 12 based on a drawing of the property 1 where the air conditioner 50 is to be installed.

The air conditioner selection section 12*c*, for example, compares the total refrigerant amount of the air conditioner 50 and the allowable refrigerant amount of the room 3 with each other to determine whether the air conditioner 50 satisfies the predetermined safety standard requirement. Specifically, when the total refrigerant amount of the air conditioner 50 is equal to or less than the allowable refrigerant amount of the room 3, the air conditioner selection section 12*c* determines that the air conditioner 50 satisfies the predetermined safety standard requirement, and is thus installable in the room 3. When there are a plurality of combinations of the outdoor unit 51 and the indoor unit 52 which constitute the air conditioner 50, the air conditioner selection section 12*c* calculates the total refrigerant amount of the air conditioner 50 for each of the combinations and determines whether the calculated total refrigerant amount is equal to or less than the allowable refrigerant amount of the room 3.

In this manner, the air conditioner selection section 12*c* selects the air conditioner 50 having a total refrigerant amount equal to or less than the allowable refrigerant amount of the room 3. The storage unit 13 stores information relating to the air conditioner 50 selected by the air conditioner selection section 12*c* as the selected air conditioner information 13*c*.

(2-4) Air Conditioner Output Section

The air conditioner output section 12*e* outputs information relating to the air conditioner 50 selected by the air conditioner selection section 12*c*. Specifically, the air conditioner output section 12*e* displays information relating to the outdoor unit 51 and the indoor unit 52 which constitute the air conditioner 50 selected by the air conditioner selection section 12*c* on the display as the output unit 14. The air conditioner 50 displayed on the display as the output unit 14 satisfies the predetermined safety standard requirement in a case where the refrigerant leaks in the room 3.

(2-5) Air Conditioner Determination Section

The air conditioner determination section 12*d* performs a process for selecting and determining the air conditioner 50 provided with the indoor unit 52 to be installed in the room 3 from one or more candidates for the air conditioner 50 selected by the air conditioner selection section 12*c* by the user of the air conditioner selection system 100. The user of the air conditioner selection system 100 determines the air conditioner 50 including the indoor unit 52 to be installed in the room 3 from the one or more candidates for the air conditioner 50 output by the air conditioner output section 12*e* to the output unit 14 using the input unit 15. The air conditioner 50 determined by the user of the air conditioner selection system 100 is stored in the storage unit 13 or output by the output unit 14.

The air conditioner determination section 12*d* may output information relating to the air conditioner 50 determined by the user of the air conditioner selection system 100 by the output unit 14. The information relating to the air conditioner 50 is, for example, the specifications of the outdoor unit 51 and the indoor unit 52 which constitute the air conditioner 50.

(3) Operation

Figure 3:
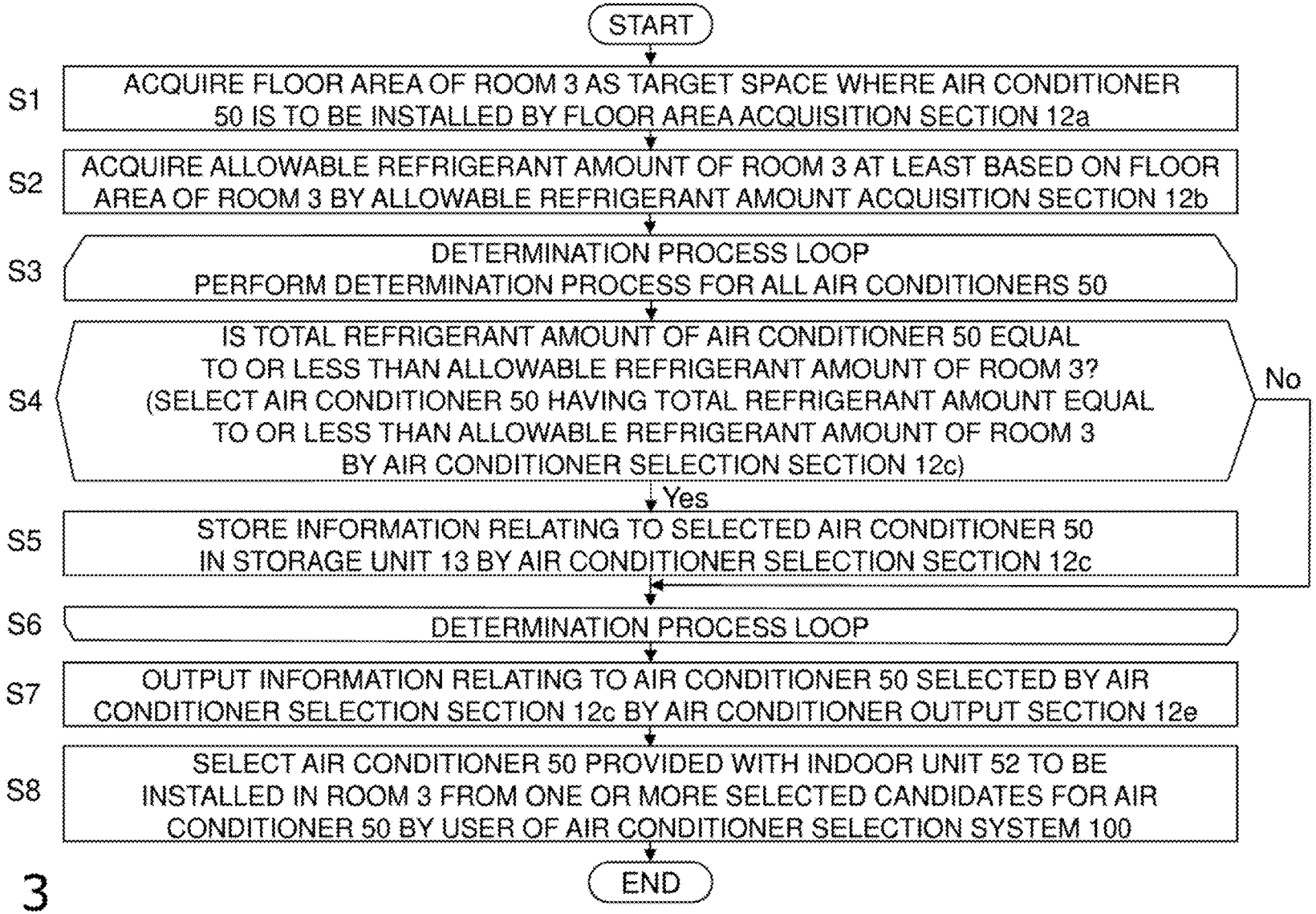
FIG. 3 is an example of a flow chart representing the operation of the air conditioner selection system 100.

FIG. 3 is an example of a flow chart representing the operation of the air conditioner selection system 100. Next, a process in which the air conditioner selection system 100 selects the air conditioner 50 based on the safety standard requirement in a case where the refrigerant leaks, and the user of the air conditioner selection system 100 determines the air conditioner 50 including the indoor unit 52 to be installed in the room 3 from the one or more selected candidates for the air conditioner 50 will be described with reference to FIG. 3.

First, the floor area acquisition section 12*a* of the computer 10 acquires the floor area of the room 3 as the target space where the air conditioner 50 is to be installed (step S1). Specifically, the floor area acquisition section 12*a* captures room spatial information, which is data relating to the internal space of the room 3, as drawing data and image data of the inside of the room 3. Then, the floor area acquisition section 12*a* acquires the floor area of the room 3 based on the captured room spatial information.

Next, the allowable refrigerant amount acquisition section 12*b* of the computer 10 acquires the allowable refrigerant amount of the room 3 at least based on the floor area of the room 3 (step S2). Specifically, the allowable refrigerant amount acquisition section 12*b* calculates the allowable refrigerant amount of the room 3 based on the floor area of the room 3, the leakage height of the room 3, and the refrigerant parameter by the above formula (I).

Next, the air conditioner selection section 12*c* of the computer 10 performs a determination process to determine whether the safety standard requirement in refrigerant leakage is satisfied for all air conditioners 50 (steps S3 to S6). All air conditioners 50 indicate all possible combinations of outdoor units 51 and indoor units 52.

In the determination process, the air conditioner selection section 12*c* determines whether the total refrigerant amount of the air conditioner 50 is equal to or less than the allowable refrigerant amount of the room 3 (step S4). The total refrigerant amount of the air conditioner 50 is acquired based on the specifications of the outdoor unit 51 and the indoor unit 52, the number of indoor units 52, and the length of the refrigerant pipe. The air conditioner selection section 12*c* determines whether the total refrigerant amount of the air conditioner 50 is equal to or less than the allowable refrigerant amount of the room 3 for all the air conditioners 50 to be determined (all the combinations of outdoor units 51 and indoor units 52). When the air conditioner selection section 12*c* determines that the total refrigerant amount of the conditioner 50 is equal to or less than the allowable refrigerant amount of the room 3, the air conditioner selection section 12*c* stores information relating to the air conditioner 50 in the storage unit 13 (step S5). On the other hand, when the air conditioner selection section 12*c* determines that the total refrigerant amount of the conditioner 50 is not equal to or less than the allowable refrigerant amount of the room 3, the air conditioner selection section 12*c* performs the same determination process for the next air conditioner 50 (step S4). The air conditioner 50 determined to have a total refrigerant amount equal to or less than the allowable refrigerant amount of the room 3 satisfies the safety standard requirement in refrigerant leakage. That is, the air conditioner selection section 12*c* selects only the air conditioner 50 having a total refrigerant amount equal to or less than the allowable refrigerant amount of the room 3 from all the air conditioners 50.

Next, the air conditioner output section 12*e* of the computer 10 outputs the information relating to the air conditioner 50 selected by the air conditioner selection section 12*c* (step S7). The air conditioner output section 12*e* displays the information relating to the selected air conditioner 50 on the display as the output unit 14 or prints the information relating to the selected air conditioner 50 using the printer as the output unit 14.

Next, the air conditioner determination section 12*d* of the computer 10 performs a process for determining the air conditioner 50 provided with the indoor unit 52 to be installed in the room 3 from one or more candidates for the air conditioner 50 selected by the air conditioner selection section 12*c* by the user of the air conditioner selection system 100 (step S8). The user of the air conditioner selection system 100, for example, operates the input unit 15 to determine the air conditioner 50 to be installed in the property 1 from the one or more candidates for the air conditioner 50 displayed on the display as the output unit 14. The air conditioner selection system 100 can select the air conditioner 50 that satisfies the safety standard requirement in a case where the refrigerant leaks and present the selected air conditioner 50 to the user of the air conditioner selection system 100 by the above processes. The user of the air conditioner selection system 100 can determine the air conditioner 50 to be installed in the property 1 from the one or more selected candidates for the air conditioner 50.

(4) Characteristics (4-1)

The air conditioner selection system 100 of the present embodiment selects the air conditioner 50 that satisfies the safety standard requirement in a case where the refrigerant leaks into the room 3 inside the property 1. The air conditioner selection system 100 acquires the allowable refrigerant amount of the room 3 at least based on the floor area of the room 3 where the indoor unit 52 as the air conditioning unit that constitutes the air conditioner 50 is to be installed in order to select the air conditioner 50. The allowable refrigerant amount of the room 3 is the amount of a refrigerant allowed to remain in the room 3 when the refrigerant leaks out of the air conditioner 50 in the room 3. The air conditioner selection system 100 selects the air conditioner 50 that satisfies the safety standard requirement in refrigerant leakage based on the allowable refrigerant amount of the room 3. The user of the air conditioner selection system 100 can determine the air conditioner 50 to be installed in the property 1 from the one or more selected air conditioners 50.

When the property 1 is a building including a plurality of rooms 3, for example, it may be detected that the air conditioner 50 planned to be installed in the property 1 does not satisfy the predetermined safety standard requirement in the construction stage of the property 1 when the air conditioner 50 to be installed in the property 1 is not appropriately determined in the design stage of the property 1. In this case, it may become impossible to construct the property 1, which may generate cost for an operation such as repreparation of the construction of the property 1.

The air conditioner selection system 100 of the present embodiment is capable of determining whether the air conditioner 50 is installable in the property 1 in view of the safety standard requirement in refrigerant leakage. Thus, the air conditioner selection system 100 is capable of efficiently selecting the air conditioner 50 that satisfies the safety standard requirement in a case where the refrigerant leaks into the room 3 and notifying the person in charge of constructing the property 1 in the design stage of the property 1. Thus, the air conditioner selection system 100 can reduce cost which may be generated when the air conditioner 50 to be installed in the property 1 is not appropriately determined.

(4-2)

The air conditioner selection system 100 of the present embodiment has a function of displaying information relating to the air conditioner 50 selected based on the safety standard requirement in a case where the refrigerant leaks into the room 3 on the display as the output unit 14 of the computer 10. The user of the air conditioner selection system 100 can determine the air conditioner 50 provided with the outdoor unit 51 and the indoor unit 52 to be installed in the property 1 from the one or more air conditioners 50 displayed on the display. Thus, the person in charge of constructing the property 1 can efficiently determine the outdoor unit 51 and the indoor unit 52 which constitute the air conditioner 50 that satisfies the safety standard requirement in a case where the refrigerant leaks using the air conditioner selection system 100.

(4-3)

The air conditioner selection system 100 of the present embodiment calculates the allowable refrigerant amount of the room 3 where the indoor unit 52 is to be installed based on the floor area of the room 3, the leakage height of the room 3, and the refrigerant parameter by the above formula (I). The refrigerant parameter is a value determined by the property of the refrigerant and calculated from the flammability and the lower flammable limit of the refrigerant. Thus, the air conditioner selection system 100 is capable of appropriately selecting the air conditioner 50 that satisfies the safety standard requirement in a case where the refrigerant leaks into the room 3 according to the property of the refrigerant used in the air conditioner 50. In particular, the air conditioner selection system 100 is capable of appropriately selecting the air conditioner 50 that satisfies the safety standard requirement in a case where a flammable refrigerant such as R32 leaks into the room 3.

(5) Modifications

Applicable modifications of the embodiment of the present invention will be described.

(5-1) Modification A

In the air conditioner selection system 100 of the present embodiment, the allowable refrigerant amount acquisition section 12*b* of the computer 10 calculates the allowable refrigerant amount of the room 3 where the indoor unit 52 is to be installed based on the floor area of the room 3, the leakage height of the room 3, and the refrigerant parameter by the above formula (I). Alternatively, the allowable refrigerant amount of the room 3 may be calculated using a target space height instead of the leakage height of the room 3. The target space height is the dimension of the room 3 in the vertical direction. When the spatial shape of the room 3 is regarded as a cylinder body, the target space height is the height of the cylinder body. The target space height corresponds to the distance from the floor to the ceiling of the room 3.

In the present modification, the allowable refrigerant amount acquisition section 12*b* calculates the allowable refrigerant amount V by the following formula (II).

$$V=k\times L\times h'\times S \quad \text{(II)}$$

In formula (II), variables k, L, and S are the same as the variables k, L, and S of formula (I), respectively. In formula (II), a variable h' is the target space height of the room 3. The allowable refrigerant amount acquisition section 12*b* acquires the target space height of the room 3 based on room spatial information captured by the floor area acquisition section 12*a*.

Further, in the embodiment, the leakage height of the room 3 may be set based on the target space height of the room 3. For example, the leakage height of the room 3 may be set to half the target space height of the room 3. In this case, even when the user of the air conditioner selection system 100 does not set the leakage height of the room 3, the allowable refrigerant amount acquisition section 12*b* is capable of automatically calculating the allowable refrigerant amount.

In the present modification, it is not necessary for the user of the air conditioner selection system 100 to set the leakage height of the room 3 and the type of the indoor unit 52 in order to acquire the allowable refrigerant amount by the allowable refrigerant amount acquisition section 12*b*. Thus, the air conditioner selection system 100 is capable of efficiently selecting the air conditioner 50 that satisfies the safety standard requirement in a case where the refrigerant leaks into the room 3. (5-2) Modification B In the air conditioner selection system 100 of the embodiment, the air conditioner selection section 12*c* of the computer 10 selects the air conditioner 50 based on the allowable refrigerant amount of the room 3 where the indoor unit 52 is to be installed. Alternatively, the air conditioner selection section 12*c* may select the air conditioner 50 based on another parameter in addition to the allowable refrigerant amount of the room 3. For example, the air conditioner selection section 12*c* may select the air conditioner 50 based on the allowable refrigerant amount of the room 3 and an air conditioning capacity required of the room 3.

The air conditioning capacity required of the room 3 is, for example, calculated based on specifications of each of the property 1, the room 3, and the air conditioner 50. The specifications of the property 1 include a use, a place, and a material of a building as the property 1. The specifications of the room 3 include a use, the number of floors, an orientation, a position inside the property 1, and a heat insulating material of a wall of the room 3. The specifications of the air conditioner 50 include the types of the outdoor unit 51 and the indoor unit 52, the number of outdoor units 51 and indoor units 52 installed, and installation locations of the outdoor unit 51 and the indoor unit 52. The computer 10 captures information relating to the specifications of the property 1, the room 3, and the air conditioner 50 automatically from an external database via the communication unit 11 or by input by the user of the air conditioner selection system 100.

Figure 4:
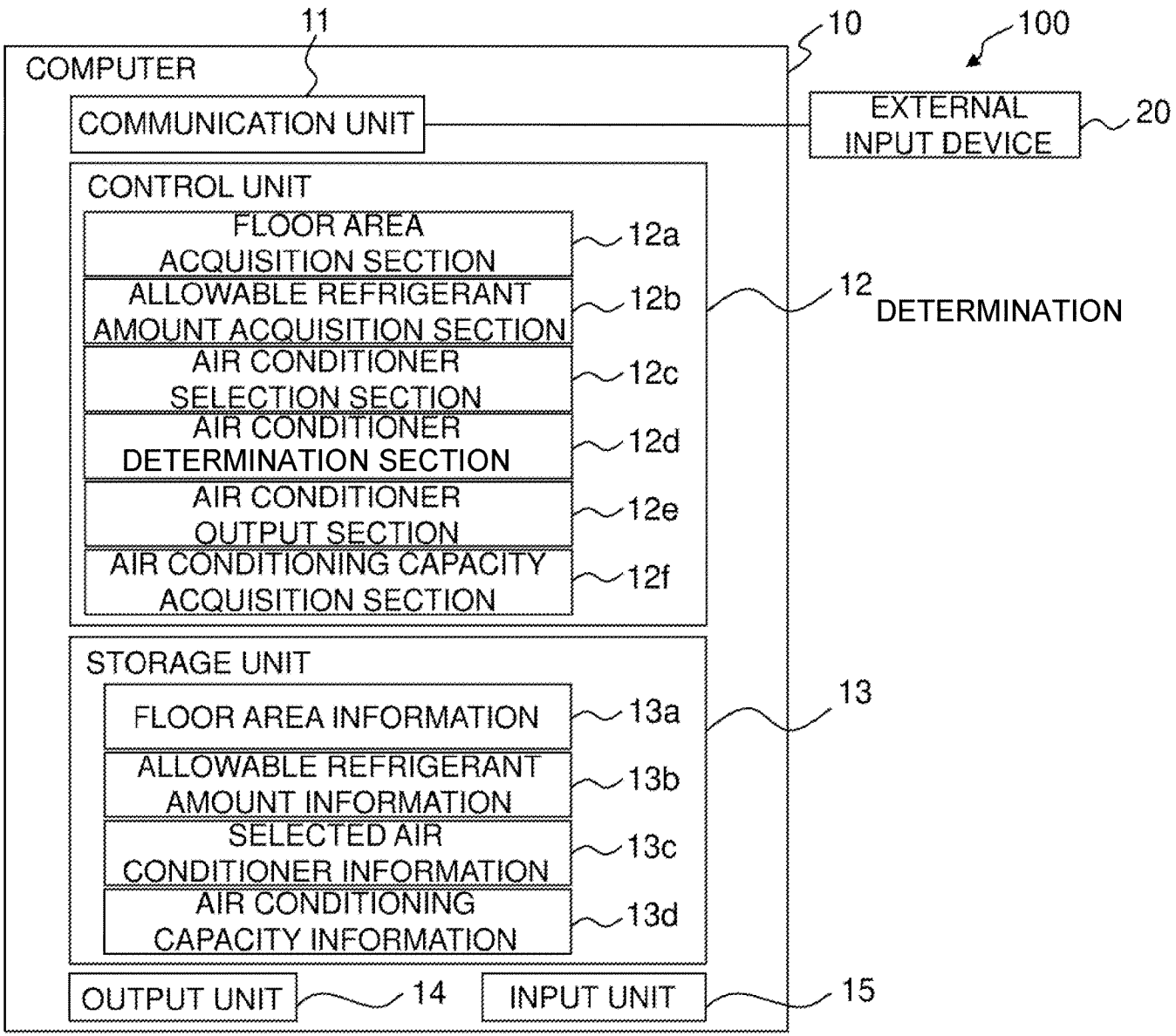
FIG. 4 is a block diagram illustrating the entire configuration of an air conditioner selection system 100 of a modification B.

In the present modification, the control unit 12 further executes an air conditioning capacity acquisition section 12*f*, and the storage unit 13 further stores air conditioning capacity information 13*d*. FIG. 4 is a diagram illustrating the entire configuration of an air conditioner selection system 100 of the present modification. The air conditioning capacity acquisition section 12*f* acquires the air conditioning capacity required of the room 3. The air conditioning capacity acquisition section 12*f*, for example, acquires the air conditioning capacity required of the room 3 based on the specifications of the property 1, the room 3, and the air conditioner 50 which are input by the user of the air conditioner selection system 100. The storage unit 13 stores the air conditioning capacity required of the room 3 as the air conditioning capacity information 13*d*. The air conditioner selection section 12*c* selects the air conditioner 50 based on the allowable refrigerant amount of the room 3 acquired by the allowable refrigerant amount acquisition section 12*b* and the air conditioning capacity required of the room 3 acquired by the air conditioning capacity acquisition section 12*f*. For example, the air conditioner selection section 12*c* selects the air conditioner 50 that has a total refrigerant amount equal to or less than the allowable refrigerant amount of the room 3 and at least has the air conditioning capacity required of the room 3.

In the present modification, the air conditioner selection system 100 is capable of efficiently selecting the air conditioner 50 having the air conditioning capacity required of the room 3 where the indoor unit 52 is to be installed.

(5-3) Modification C

In the air conditioner selection system 100 of the embodiment, the air conditioner determination section 12*d* of the computer 10 performs the process for determining the air conditioner 50 provided with the indoor unit 52 to be installed in the room 3 from one or more candidates for the air conditioner 50 selected by the air conditioner selection section 12*c* by the user of the air conditioner selection system 100. Alternatively, the air conditioner determination section 12*d* may have a function capable of determining the air conditioner 50 that satisfies a predetermined condition from one or more candidates for the air conditioner 50 selected by the air conditioner selection section 12*c* by the user of the air conditioner selection system 100. The predetermined condition is, for example, a condition relating to the types and the functions of the outdoor unit 51 and the indoor unit 52. In the present modification, the user of the air conditioner selection system 100 can determine the air conditioner 50 that conforms to a condition desired by the user as the combination of the outdoor unit 51 and the indoor unit 52 from one or more selected candidates for the air conditioner 50.

(5-4) Modification D

The user of the air conditioner selection system 100 of the embodiment can determine the air conditioner 50 including the indoor unit 52 to be installed in the room 3 from one or more candidates for the air conditioner 50 selected by the air conditioner selection section 12*c*. The air conditioner selection system 100 may further create a check sheet relating to a detection sensor and an alarm device which can be attached to the room 3 when the air conditioner 50 determined by the user is installed. The detection sensor is, for example, a sensor that detects the refrigerant leaking into the room 3. The alarm device is, for example, a device that issues an alarm when the detection sensor detects leakage of the refrigerant. The user of the air conditioner selection system 100 can prevent the required detection sensor and the required alarm device from being forgotten to be attached to the room 3 where the indoor unit 52 is to be installed by referring to the check sheet when the air conditioner 50 is installed.

(5-5) Modification E

The user of the air conditioner selection system 100 of the embodiment can determine the air conditioner 50 including the indoor unit 52 to be installed in the room 3 from one or more candidates for the air conditioner 50 selected by the air conditioner selection section 12*c*. The air conditioner selection system 100 may further have a function of automatically ordering the air conditioner 50 determined by the user. In this case, for example, the air conditioner selection system 100 is connected to a system and a Web site for ordering the air conditioner 50 via a network.

In the present modification, the user of the air conditioner selection system 100 can order the air conditioner 50 to be installed in the property 1 simultaneously with determining the air conditioner 50.

(5-6) Modification F

The air conditioner selection system 100 of the embodiment is a system for selecting the air conditioner 50 that satisfies the safety standard requirement in a case where the refrigerant leaks into the room 3 where the indoor unit 52 is to be installed.

However, the outdoor unit 51 may be installed in a place where the refrigerant leaking out of the outdoor unit 51 and an outdoor refrigerant pipe is prone to remain depending on the property 1 where the air conditioner 50 is to be installed. For example, when the outdoor unit 51 is installed in a location recessed from the surroundings such as a semibasement of the property 1, the refrigerant leaking out of the outdoor unit 51 is prone to remain around the outdoor unit 51. Thus, in this case, the air conditioner selection system 100 is preferably capable of selecting the air conditioner 50 that satisfies a safety standard requirement in a case where the refrigerant leaks around the outdoor unit 51 in addition to the safety standard requirement in a case where the refrigerant leaks into the room 3.

The air conditioner selection system 100 of the present modification is capable of selecting the air conditioner 50 that satisfies the safety standard requirement in a case where the refrigerant leaks around the outdoor unit 51. In this case, the floor area acquisition section 12*a* acquires the floor area of a space where the outdoor unit 51 is to be installed. The floor area of the space where the outdoor unit 51 is to be installed is, for example, the floor area of a semibasement part when the outdoor unit 51 is installed in the semibasement. Further, when the outdoor unit 51 is installed in a part recessed from the surroundings, the floor area acquisition section 12*a* acquires the floor area of the recessed part. The allowable refrigerant amount acquisition section 12*b* acquires an allowable refrigerant amount in the space where the outdoor unit 51 is to be installed based on the floor area acquired by the floor area acquisition section 12*a*. The air conditioner determination section 12*d* selects the air conditioner 50 that satisfies the safety standard requirement in a case where the refrigerant leaks around the outdoor unit 51 based on the allowable refrigerant amount acquired by the allowable refrigerant amount acquisition section 12*b*.

Further, when the outdoor unit 51 is installed in a semibasement, the air conditioner selection system 100 may select the air conditioner 50 that satisfies the safety standard requirement in a case where the refrigerant leaks around the outdoor unit 51 only when the depth of the semibasement part is equal to or more than a predetermined value. In this case, the predetermined value is, for example, 1.2 m. The depth of the semibasement part is the distance from the floor to the ground surface in the semibasement part in the vertical direction.

When the outdoor unit 51 is installed in the semibasement, the allowable refrigerant amount acquisition section 12*b* may calculate the allowable refrigerant amount by assigning 0.50 to k in the above formula (I) regardless of the flammability of the refrigerant.

(5-7) Modification G

The air conditioner selection system 100 of the embodiment is provided with the computer 10 which is a personal computer such as a laptop computer and the external input device 20 which is a camera and a scanner. The user of the air conditioner selection system 100 can efficiently select the air conditioner 50 that satisfies the safety standard requirement in a case where the refrigerant leaks into the room 3 using the computer 10 and the external input device 20.

Alternatively, the user of the air conditioner selection system 100 may select the air conditioner 50 using a device including the computer 10 and the external input device 20 which are integrated together. For example, the user of the air conditioner selection system 100 may select the air conditioner 50 using a smartphone with a camera function. In this case, the smartphone has functions of both the computer 10 and the external input device 20 of the embodiment.

(5-8) Modification H

In the air conditioner selection system 100 of the embodiment, the air conditioner 50 selected by the air conditioner selection section 12*c* is the single-system packaged air conditioner which includes one outdoor unit 51 and a plurality of indoor units 52. In the embodiment, only one air conditioner 50 is installed in the property 1. That is, only one refrigerant system is present in the property 1.

Alternatively, a plurality of air conditioners 50 may be installed in the property 1. That is, a plurality of refrigerant systems may be present in the property 1. In this case, a plurality of indoor units 52 belonging to different refrigerant systems may be installed in the same room 3.

As an example, assuming that two indoor units 52 belonging to two different refrigerant systems are installed in one room 3, there is as possibility that the refrigerant leaks into the room 3 from the two refrigerant systems at the maximum. Thus, it is necessary for the allowable refrigerant amount acquisition section 12*b* to acquire an allowable refrigerant amount lower than the allowable refrigerant amount in a case where only one indoor unit 52 is installed in the room 3 (in the case of the embodiment). In this example, when the refrigerant capacities of the two refrigerant systems are equal to each other, the allowable refrigerant amount acquisition section 12*b* may acquire a value of half the allowable refrigerant amount in the embodiment as the allowable refrigerant amount. In this manner, in the present modification, the allowable refrigerant amount acquisition section 12*b* acquires an allowable refrigerant amount lower than that in the embodiment taking into consideration the possibility of leakage of the refrigerant into the common room 3 from a plurality of refrigerant systems.

(5-9) Modification I

The user of the air conditioner selection system 100 of the embodiment can determine the air conditioner 50 including the indoor unit 52 to be installed in the room 3 from one or more candidates for the air conditioner 50 selected by the air conditioner selection section 12*c*. When the user determines a combination of the outdoor unit 51 and the indoor unit 52, the air conditioner selection system 100 may further determine a safety function of the air conditioner 50 constituted of the combination and notify the user of a result of the determination. The safety function of the air conditioner 50 is, for example, a refrigerant leakage detection function.

INDUSTRIAL APPLICABILITY

The air conditioner selection system according to the present invention is capable of efficiently selecting an air conditioner that satisfies a safety standard requirement in a case where a refrigerant leaks.

REFERENCE SIGNS LIST

3 room (target space)
12*a* floor area acquisition section

12*b* allowable refrigerant amount acquisition section
12*c* air conditioner selection section
12*d* air conditioner determination section
12*e* air conditioner output section
12*f* air conditioning capacity acquisition section
50 air conditioner
52 indoor unit (air conditioning unit)
100 air conditioner selection system

CITATION LIST

Patent Literature

Patent Literature 1: JP 8-94150 A

The invention claimed is:

1. An air conditioner selection system for selecting a prospective air conditioner including an air conditioning unit, the air conditioner selection system comprising:

an electronic controller including a floor area acquisition section that acquires a floor area of a target space where the prospective air conditioning unit is to be installed;

an allowable refrigerant amount acquisition section that acquires an allowable refrigerant amount of a refrigerant allowed to remain in the target space at least based on the floor area acquired by the floor area acquisition section; and an air conditioner selection section that determines whether a total refrigerant amount used in the prospective air conditioner is equal to or less than the allowable refrigerant amount acquired by the allowable refrigerant amount acquisition section, and, when the total refrigerant amount is equal to or less than the allowable refrigerant amount, selects the prospective air conditioner including the air conditioning unit installable in the target space.

2. The air conditioner selection system according to claim 1, further comprising an air conditioner determination section for determining the air conditioning unit to be installed in the target space based on the prospective air conditioner selected by the air conditioner selection section.

3. The air conditioner selection system according to claim 1, wherein the allowable refrigerant amount acquisition section acquires the allowable refrigerant amount further based on a target space height that is a dimension of the target space in a vertical direction.

4. The air conditioner selection system according to claim 3, wherein the allowable refrigerant amount acquisition section acquires the allowable refrigerant amount further based on a lower flammable limit of a refrigerant.

5. The air conditioner selection system according to claim 1, further comprising an air conditioning capacity acquisition section that acquires an air conditioning capacity required of the target space, the air conditioner selection section selecting the prospective air conditioner further based on the air conditioning capacity acquired by the air conditioning capacity acquisition section.

6. The air conditioner selection system according to claim 1, further comprising an air conditioner output section that outputs the prospective air conditioner selected by the air conditioner selection section.

7. The air conditioner selection system according to claim 1, wherein the air conditioner uses a refrigerant including a flammable refrigerant.

8. The air conditioner selection system according to claim 1, wherein the allowable refrigerant amount is an amount of a refrigerant allowed to remain in the target space when the refrigerant leaks out of the prospective air conditioning unit into the target space.

* * * * *